US011634861B2

(12) United States Patent
Kim

(10) Patent No.: US 11,634,861 B2
(45) Date of Patent: Apr. 25, 2023

(54) METHOD FOR MANUFACTURING HIGH TENACITY FIBER AND HIGH TENACITY FIBER MANUFACTURED THEREBY

(71) Applicant: Yong Gun Kim, Seongnam-Si (KR)

(72) Inventor: Yong Gun Kim, Seongnam-Si (KR)

( * ) Notice: Subject to any disclaimer, the term of this patent is extended or adjusted under 35 U.S.C. 154(b) by 482 days.

(21) Appl. No.: 16/794,168

(22) Filed: Feb. 18, 2020

(65) Prior Publication Data

US 2020/0248401 A1 Aug. 6, 2020

Related U.S. Application Data

(62) Division of application No. 16/553,414, filed on Aug. 28, 2019, now Pat. No. 10,604,890.

(30) Foreign Application Priority Data

Jan. 31, 2019 (KR) ..... 10-2019-0012903

(51) Int. Cl.

| | |
|---|---|
| ***D02G 3/00*** | (2006.01) |
| ***B29C 59/10*** | (2006.01) |
| ***D06M 23/00*** | (2006.01) |
| ***D06M 15/564*** | (2006.01) |
| ***D06B 1/14*** | (2006.01) |
| ***D06M 101/32*** | (2006.01) |
| ***D06M 101/36*** | (2006.01) |

(52) U.S. Cl.
CPC ..... *D06M 23/00* (2013.01); *D06B 1/142* (2013.01); *D06M 15/564* (2013.01); *D06M 2101/32* (2013.01); *D06M 2101/36* (2013.01)

(58) Field of Classification Search
USPC ..... 428/375
See application file for complete search history.

(56) References Cited

U.S. PATENT DOCUMENTS

| | | | | |
|---|---|---|---|---|
| 10,980,310 | B2 * | 4/2021 | Bartel | C09D 7/41 |
| 2008/0118639 | A1 * | 5/2008 | Arvidson | D04H 3/04 427/175 |

* cited by examiner

*Primary Examiner* — Lynda Salvatore
(74) *Attorney, Agent, or Firm* — Saliwanchik, Lloyd & Eisenschenk

(57) ABSTRACT

The present invention relates to a method of manufacturing a high tenacity yarn and a high tenacity yarn manufactured thereby. More particularly, the present invention relates to: a method of manufacturing a high tenacity yarn, the method including coating a yarn made of at least one of nylon and polyester to obtain a coated yarn, wherein the coating material contains 3 to 35 parts by weight of a reinforcing agent composed of a mineral material per 100 parts by weight of a coating liquid containing polyurethane; and a high tenacity yarn manufactured thereby. Therefore, it is possible to manufacture a yarn having high tenacity and improved processability by processing a nylon or polyester yarn having a relatively low tenacity as compared with a high modulus polyethylene (HMPE) yarn by use of a yarn coating technique, and further to reduce production cost.

1 Claim, 7 Drawing Sheets

| Performance Level | Average Cut Index |
|---|---|
| 0 | < 1.2 |
| 1 | 1.2 – 2.4 |
| 2 | 2.5 – 4.9 |
| 3 | 5.0 – 9.9 |
| 4 | 10.0 – 19.9 |
| 5 | ≥ 20 |

METHOD FOR MANUFACTURING HIGH TENACITY FIBER AND HIGH TENACITY FIBER MANUFACTURED THEREBY

BACKGROUND OF THE INVENTION

Field of the Invention

The present invention relates generally to a method of manufacturing a high tenacity yarn and a high tenacity yarn manufactured thereby. More particularly, the present invention relates to a method of manufacturing a high tenacity yarn and a high tenacity yarn manufactured thereby, whereby a yarn having high tenacity and improved processability can be manufactured using a yarn coating technique, and further production cost can be reduced.

Description of the Related Art

In general, a coating glove denotes a glove which is formed by coating the surface of a knitted glove knitted with nylon yarn, spandex yarn, cotton yarn or polyester yarn, glass yarn, and the like to impart abrasion resistance, tear strength, punching resistance, slipping resistance, air permeability, water resistance, and the like.

Furthermore, in industrial fields requiring special safety, protective gears such as gloves and helmets are used to protect workers. Of such protective gear, gloves have recently been made using a material such as high modulus polyethylene (HMPE) fiber and the like which has sufficient tenacity to protect workers' hands.

A yarn made of HMPE fiber used herein has a thickness of about 400 deniers to secure processability and adequate tenacity. However, such HMPE fiber is more expensive than nylon or polyester fiber, resulting in an increased production cost in mass production.

On the other hand, while nylon or polyester fiber is less expensive than HMPE fiber and can be used to manufacture a product having a low thickness, nylon or polyester fiber is currently not used as yarn for producing high-strength gloves because of a low tenacity thereof.

In addition, a yarn made of glass fiber has a low abrasion resistance, tends to be brittle, and dust is scattered upon breakage, thus being difficult to use to knit gloves and the like.

The foregoing is intended merely to aid in the understanding of the background of the present invention, and is not intended to mean that the present invention falls within the purview of the related art that is already known to those skilled in the art.

Documents of Related Art (Patent document 1) Korean Patent No. 10-0729531 'Rubber-coated glove and manufacturing method thereof'

SUMMARY OF THE INVENTION

Accordingly, the present invention has been made keeping in mind the above problems occurring in the related art, and an objective of the present invention is to provide a method of manufacturing a high tenacity yarn and a high tenacity yarn manufactured thereby, whereby a yarn made of nylon or polyester having a relatively low tenacity as compared with high modulus polyethylene (HMPE) is processed using a yarn coating technique, thus obtaining a yarn having high tenacity and improved processability, while reducing production cost.

In order to achieve the above objective, according to one aspect of the present invention, there is provided a method of manufacturing a high tenacity yarn, the method including coating a yarn made of at least one of nylon and polyester with a coating material to obtain a coated yarn, wherein the coating material contains 3 to 35 parts by weight of a reinforcing agent composed of a mineral material per 100 parts by weight of a coating liquid containing polyurethane.

According to another aspect of the present invention, there is provided a high tenacity yarn manufactured by the method.

According to the present invention having the above-described characteristics, a yarn made of nylon or polyester having a relatively low tenacity as compared with HMPE is coated with a coating material which contains a coating liquid containing polyurethane and a reinforcing agent composed of a mineral material. Therefore, it is possible to obtain a high tenacity yarn having tenacity comparable to that of an HMPE yarn while being thinner than the same, thus having improved processability, and further to achieve a reduction in production cost.

Furthermore, while a glove is generally knitted by a 15-gauge knitting machine by using an HMPE yarn in the related art, in the present invention, a globe can be knitted by an 18-gauge knitting machine, thus having a dense and soft texture and providing a comfortable fit.

BRIEF DESCRIPTION OF THE DRAWINGS

The above and other objectives, features and other advantages of the present invention will be more clearly understood from the following detailed description when taken in conjunction with the accompanying drawings, in which.

DETAILED DESCRIPTION OF THE INVENTION

In order to manufacture a yarn having high tenacity and improved processability by processing a nylon or polyester yarn having a relatively low tenacity as compared with a high modulus polyethylene (HMPE) yarn by use of a yarn coating technique, and further to reduce production cost, the present invention provides: a method of manufacturing a high tenacity yarn, the method including coating a yarn made of at least one of nylon and polyester to obtain a coated yarn, wherein the coating material contains 3 to 35 parts by weight of a reinforcing agent composed of a mineral material per 100 parts by weight of a coating liquid containing polyurethane; and a high tenacity yarn manufactured thereby.

Exemplary embodiments described hereinbelow are provided for fully conveying the scope and spirit of the invention to those skilled in the art, so it should be understood that the embodiments may be changed to a variety of embodiments and the scope and spirit of the invention are not limited to the embodiments described hereinbelow.

Hereinafter, a method of manufacturing a high tenacity yarn and a high tenacity yarn manufactured thereby according to the present invention will be described in detail with reference to FIGS. 1 to 7.

Figure 1:
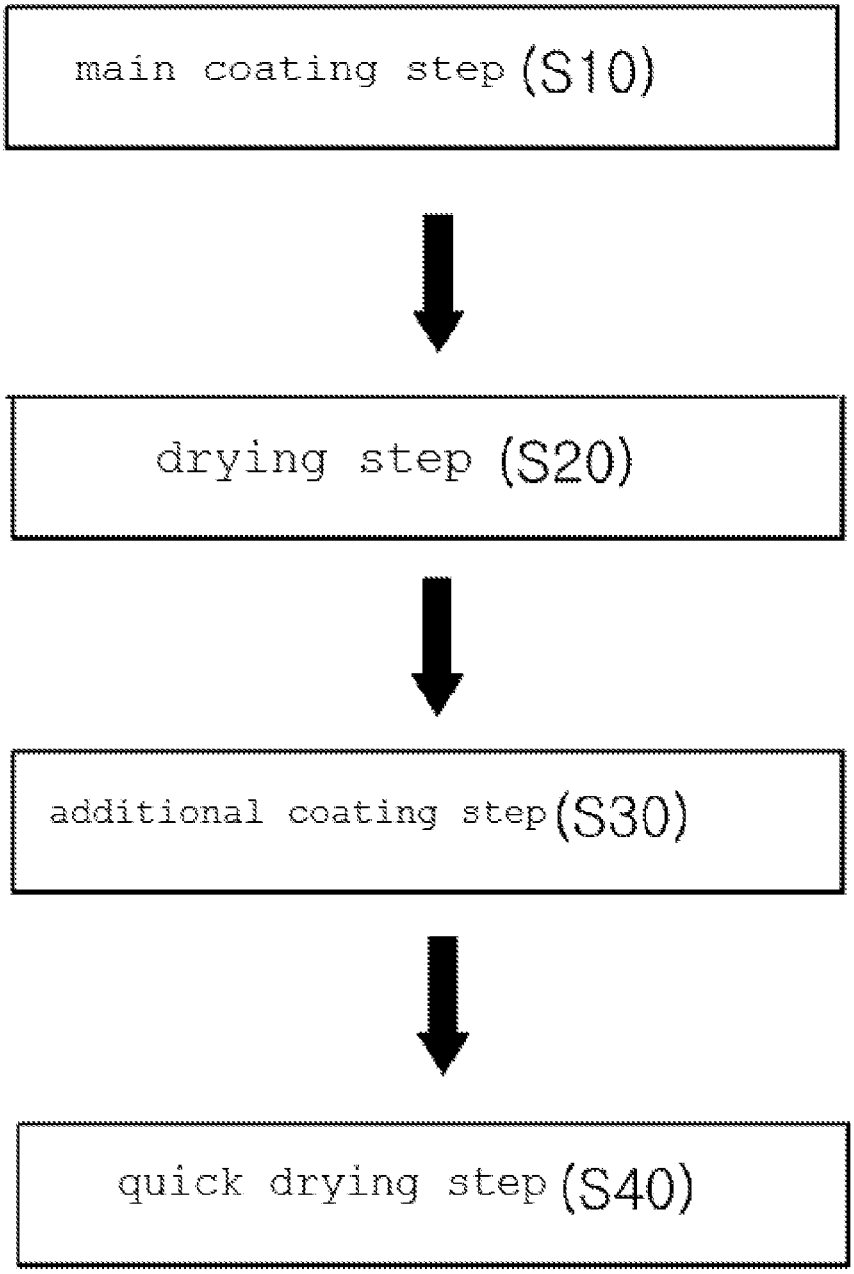
FIG. 1 is a flow chart showing a method of manufacturing a high tenacity yarn according to an embodiment of the present invention.

As shown in FIG. 1, the method of manufacturing the high tenacity yarn according to the present invention includes a main coating step S10, and may further include a drying step S20, an additional coating step S30, and a quick drying step S40.

In the main coating step S10, yarns 1 made of nylon or polyester having a relatively low tenacity as compared with high modulus polyethylene (HMPE) are coated with a coating material to obtain coated yarns. Alternatively, yarns 1 made of glass fiber which is relatively difficult to process are coated with the coating material to obtain coated yarns. The coating material used herein contains a coating liquid and a reinforcing agent. The coating liquid may contain polyurethane and water. In some cases, a dye or carbon nanotubes may be added. Furthermore, the reinforcing agent is composed of a mineral material such as basalt, glass fiber, iron, and the like.

The coating material contains 3 to 35 parts by weight of the reinforcing agent per 100 parts by weight of the coating liquid. This is because when the amount of the reinforcing agent is less than 3 parts by weight, a sufficient tenacity is not secured, while when the amount is greater than 35 parts by weight, the processability is lowered.

Furthermore, it is preferable that the mineral material is in a powder form having a particle size of 30 to 500 μm. This is because when the particle size of the mineral material is less than 30 μm, the tenacity is lowered, while when the particle size of the mineral material is greater than 500 μm, the yarns 1 are broken during a manufacturing process due to an increased weight and further the yarns 1 are not properly coated.

Figure 2:
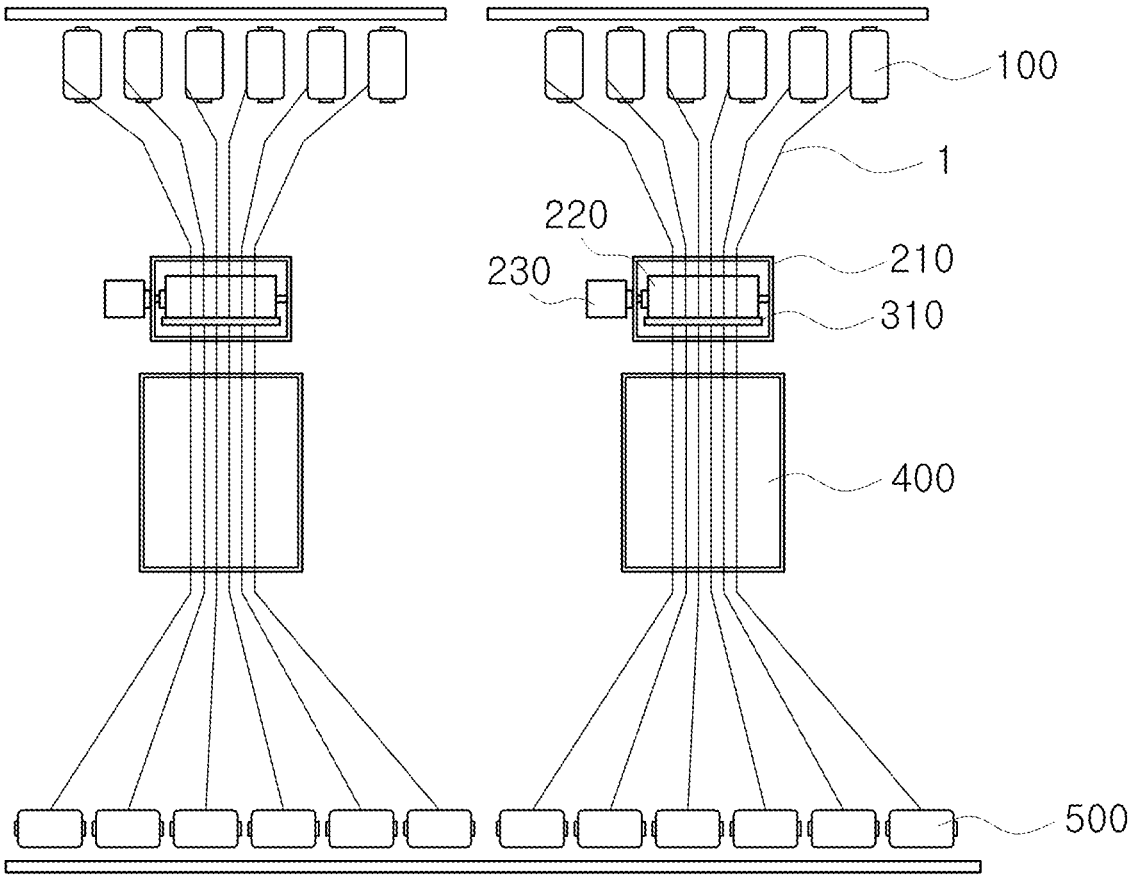
FIGS. 2 to 5 are schematic views showing an example of an apparatus used in the method of manufacturing the high tenacity yarn according to the present invention.
Figure 3:
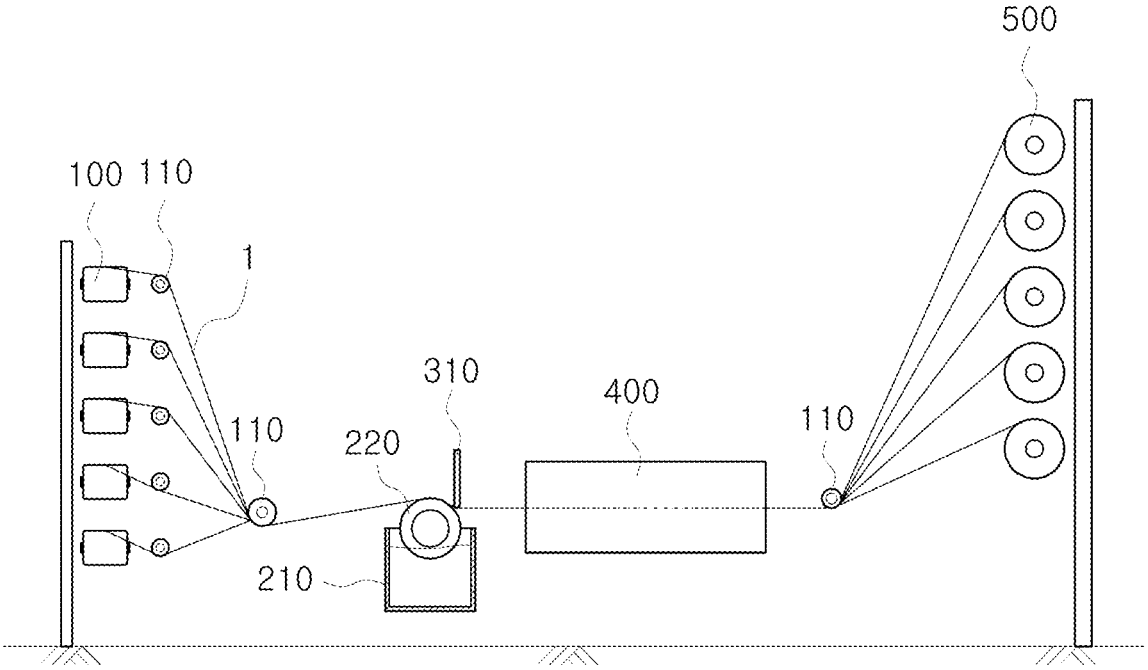

An example for performing the main coating step S20 will now be described. As shown in FIGS. 2 and 3, the yarns 1 wound on bobbins 100 pass over a roller 220 provided in a water bath 210 containing the coating material. At this time, tensioners 110 provided at respective positions adjacent to the bobbins 100 and the water bath 210 pull the yarns 1 tightly. This allows the yarns 1 to be uniformly fed to the roller 220 and allows the yarns 1 fed to the rollers 220 to be uniformly coated with the coating material.

Furthermore, while the speed of the roller 220 may vary depending on the kind of the yarns 1, it is preferable that the yarns 1 pass over the rollers 220 at a speed of about 5 to 30 m per minute in order to perform a uniform and regular coating with the coating material.

As described above, the present invention is characterized in that the yarns 1 made of nylon or polyester having a relatively low tenacity as compared with HMPE are coated with the coating material containing the polyurethane-containing coating liquid and the reinforcing agent composed of the mineral material. This makes it possible to obtain high tenacity yarns having tenacity comparable to that of HMPE yarns while being thinner than the same, thus having improved processability, and further to achieve a reduction in production cost.

The present invention is also characterized in that the yarns 1 made of glass fiber which is relatively difficult to process are coated with the coating material containing the polyurethane-containing coating liquid and the reinforcing agent composed of the mineral material. This makes it possible to obtain yarns having high tenacity while being thinner than glass yarns having a similar tenacity, thus having improved processability.

Meanwhile, the main coating step S10 may include a coating thickness control step of controlling the thickness of the coating material coated on the yarns 1. In an example of performing the coating thickness control step as shown in FIGS. 2 and 3, the thickness of the coating material is controlled by using a thickness control plate 310 which is moved vertically from above, below, or above and below the yarns 1.

In detail, in the case of the thickness control plate 310 located above the yarns 1 as shown in the drawing, the thickness control plate 310 has a lower end being in fine contact with the yarns 1 and removes excessive coating material from upper surfaces of the yarns 1 to match the thickness of coating layers of final high tenacity yarns to be manufactured. Due to the fact that the thickness control plate 310 can be moved vertically, the thickness of the coating material can be controlled by moving the thickness control plate 310 and controlling the degree of contact of the thickness control plate 310 with the yarns 1. This makes it possible to vary the thickness of the coating material depending on uses of high tenacity yarns to be manufactured.

Meanwhile, after the main coating step S10, the method may further include the drying step S20 of drying the coated yarns coated with the coating material. The drying step S20 is a process for drying the coated yarns with the thickness of the coating material controlled.

In an example, as shown in FIGS. 2 and 3, a drying furnace 400 is used through which the coated yarns pass. In the drying step 20, the coated yarns are dried by far-infrared radiation at 100 to 600° C. The length of the drying furnace 400 may be varied to control the time for the coated yarns to pass through the drying furnace 400 at a predetermined drying temperature, which can control the drying speed. Increasing the drying speed contributes to an increase in productivity, and thus the length of the drying furnace 400 can be controlled depending on the amount of yarns to be manufactured.

Furthermore, the coating liquid used in the main coating step S10 may contain carbon nanotubes. In the drying step S20, the coated yarns passing through the inside of the drying furnace 400 is dried at a first temperature to activate the carbon nanotubes contained in the coated yarns such that nanoparticles contained in the coating material are mixed well. Then, the coated yarns are dried by far-infrared radiation at a second temperature lower than the first temperature.

Figure 4:
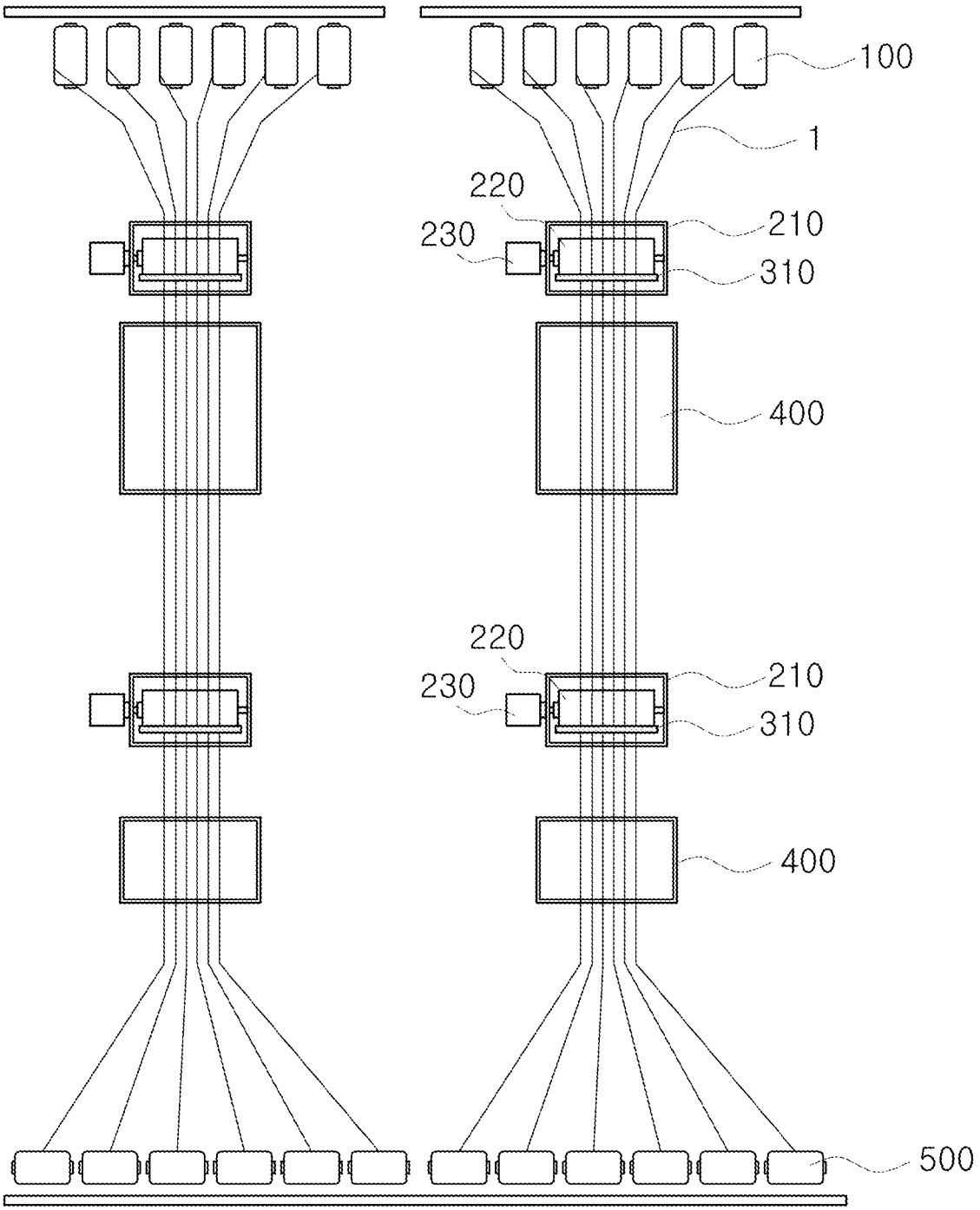
Figure 5:
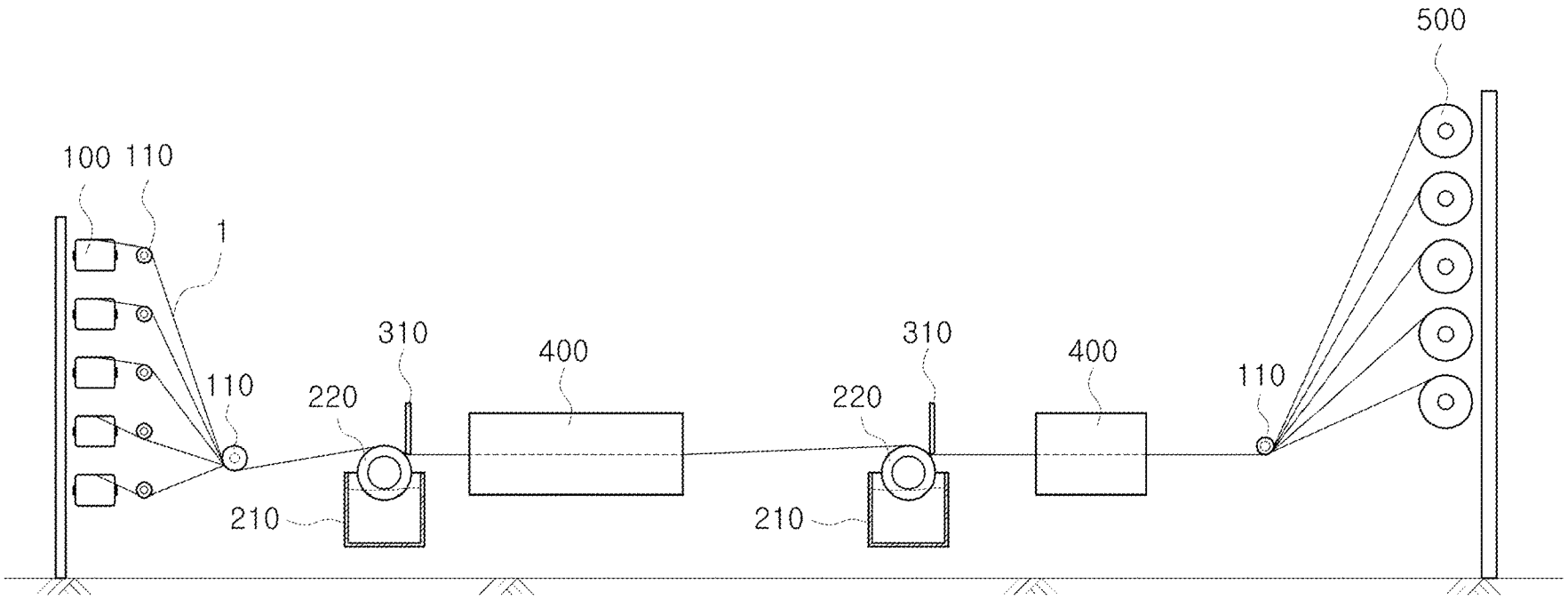

High tenacity yarns obtained through the drying step S20 in such a manner are wound on a winder 500 to manufacture final products as shown in FIGS. 2 and 3, and also may be further subjected to the additional coating step S30 and/or the quick drying step S40 as shown in FIGS. 4 and 5. This is to manufacture high tenacity yarns having various properties.

The additional coating step S30 is a process for coating the dried coated yarns with an additional coating material to obtain secondary coated yarns. It is preferable that the additional coating material is obtained by diluting the coating material to have a concentration of 60 to 80%. High tenacity yarns manufactured in such a manner are configured such that an outer coating layer of each of the high tenacity yarns has a relatively low amount of polyurethane as compared with an initial coating layer, and thus a certain degree of flexibility can be secured. In addition, various physical properties can be secured while securing high tenacity as compared with the case of forming one coating layer.

The secondary coated yarns obtained through the additional coating step S30 may be naturally dried or may be dried by the same drying method as that of the drying step S20. However, it is preferable that the secondary coated yarns are subjected to the quick drying step S40.

In the quick drying step S40, the secondary coated yarns passing through the inside of a drying furnace 400 are dried by far-infrared radiation at 100 to 600° C. for a shorter time than in the drying step S20. To this end, as shown in FIGS. 4 and 5, the length of the drying furnace 400 used in the quick drying step S40 is shorter than that of the drying furnace 400 used in the drying step S20.

Figure 6:
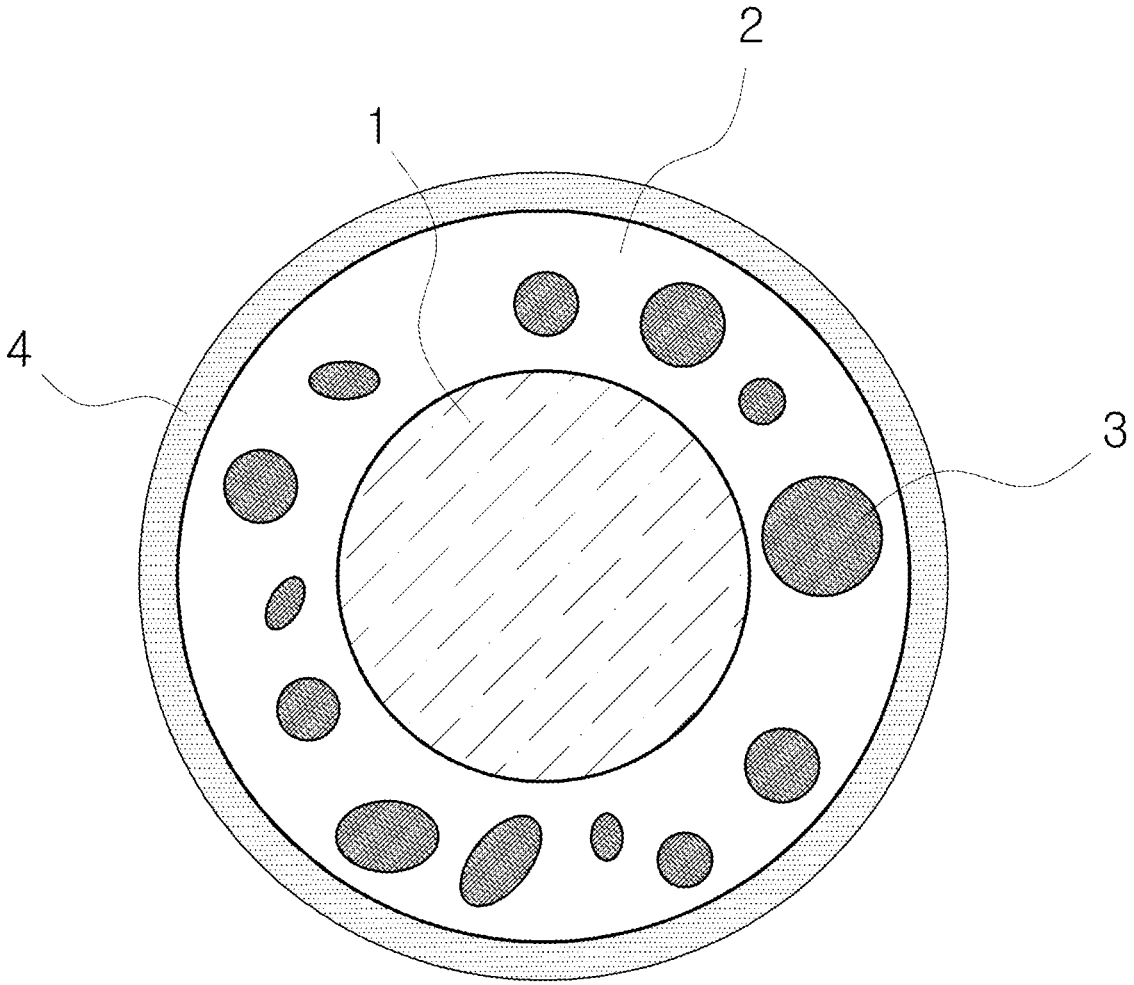
FIG. 6 is a cross-sectional view showing a structure of a high tenacity yarn according to an embodiment of the present invention manufactured by the method of manufacturing the high tenacity yarn.

As shown in FIGS. 6, each of high tenacity yarns manufactured by the method as described above includes a primary coating layer 2 surrounding a yarn 1 made of at least one of nylon, polyester, and glass fiber, and carbon nanotubes 3 are included in the primary coating layer 2. Furthermore, a secondary coating layer 4 surrounding the primary coating layer 2 may be formed by further performing the additional coating step S30 and the quick drying step S40.

In an example of the high tenacity yarns, a high tenacity yarn made of nylon or polyester fiber having a thickness of 100 deniers can have a tenacity comparable to that of a high tenacity yarn made of HMPE fiber having a thickness of 400 deniers, and can have excellent processability due to a low thickness thereof, thus making it possible to produce products such as dense gloves and the like. It is also possible to lower the cost of yarn, thus achieving a reduction in production cost.

Furthermore, while a glove is generally knitted by a 15-gauge knitting machine by using an HMPE yarn in the related art, in the present invention, a globe can be knitted by an 18-gauge knitting machine, thus having a dense and soft texture and providing a comfortable fit.

In an another example of the high tenacity yarns, while a glass fiber having a thickness of about 100 deniers is generally required to have a thickness of about 200 deniers in order to have double the tenacity, a high tenacity yarn manufactured by the above method using the yarns 1 made of glass fiber can have double the tenacity even with a thickness of about 130 deniers. Therefore, it is possible to obtain an effect of securing the processability while improving the tenacity.

Figure 7:
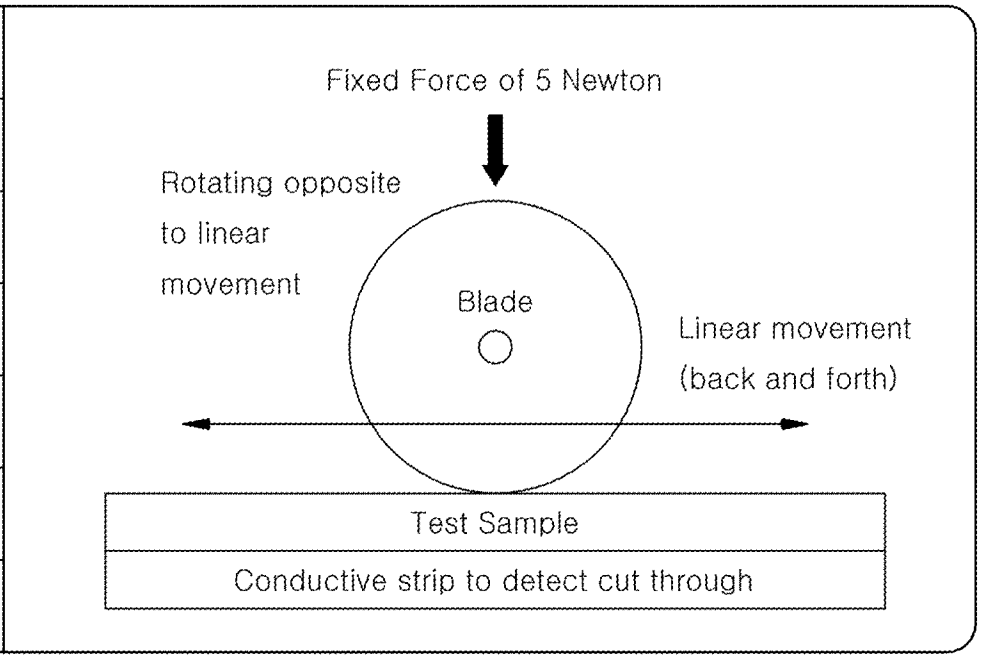
FIG. 7 is an exemplary view showing a cut level test method for checking tenacity improvement of the high tenacity yarn manufactured by the method of manufacturing the high tenacity yarn according to the present invention.

A cut level test was performed on a high tenacity yarn manufactured by the above method. The cut level test was performed in such a manner that a test sample is place between a test plate and a blade as shown in FIG. 7, the blade is moved back and forth, and the number of rotations of the blade until the test sample is cut and an electrical signal is transmitted from the blade to the test plate is measured.

When a measured average number of rotations of the blade is less than 1.2, a cut level of '0' was given, and a cut level of '1' for the average number of rotations of 1.2 to 2.4, a cut level of '2' for the average number of rotations of 2.5 to 4.9, a cut level of '3' for the average number of rotations of 5.0 to 9.9, a cut level of '4' for the average number of rotations of 10.0 to 19.9, and a cut level of '5' for the average number of rotations of equal to or greater than 20.

For reference, the cut level is '0' for nylon and polyester yarn, and the cut level is '3' for glass yarn.

Example 1

A yarn made of nylon fiber is coated with a coating material to obtain a coated yarn, in which the coating material contains 2 to 36 parts by weight of a reinforcing agent composed of a mineral material per 100 parts by weight of a coating liquid containing polyurethane. Table 1 below shows results of the cut level test for the coated yarn thus formed.

TABLE 1

| Amount of reinforcing agent(parts by weight) | Number of rotations of blade (times) | Cut level |
|---|---|---|
| 2 | 1.5 | 1 |
| 3 | 5.0 | 3 |
| 20 | 7.2 | 3 |
| 35 | 9.8 | 3 |
| 36 | 2.6 | Not measurable or 2 |

It was found that when the amount of the reinforcing agent composed of the mineral material was 3 to 35 parts by weight per 100 parts by weight of the coating liquid, the cut level of '3' was given, and thus a high tenacity yarn having sufficient tenacity was obtained.

However, it was found that when the amount of the reinforcing agent was 2 parts by weight, the cut level of '1' was given, and thus sufficient tenacity was not obtained. It was also found that when the amount of the reinforcing agent was 36 parts by weight, the cut level was not measurable because the coated yarn was broken during a manufacturing process, or the cut level of '2' was given because coating was not properly performed, and thus sufficient tenacity was not obtained.

Example 2

A yarn made of polyester is coated with a coating material to obtain a coated yarn, in which the coating material contains 2 to 36 parts by weight of a reinforcing agent composed of a mineral material per 100 parts by weight of a coating liquid containing polyurethane. Table 2 below shows results of the cut level test for the coated yarn thus formed.

TABLE 2

| Amount of reinforcing agent(parts by weight) | Number of rotations of blade (times) | Cut level |
|---|---|---|
| 2 | 2.0 | 1 |
| 3 | 5.2 | 3 |
| 20 | 7.3 | 3 |
| 35 | 9.9 | 3 |
| 36 | 4.4 | Not measurable or 2 |

It was found that when the amount of the reinforcing agent composed of the mineral material was 3 to 35 parts by weight per 100 parts by weight of the coating liquid, the cut level of '3' was given, and thus a high tenacity yarn having sufficient tenacity was obtained. However, it was found that when the amount of the reinforcing agent was 2 parts by weight, the cut level of '1' was given, and thus sufficient tenacity was not obtained. It was also found that when the amount of the reinforcing agent was 36 parts by weight, the cut level was not measurable because the coated yarn was broken during a manufacturing process, or the cut level of '2' was given because coating was not properly performed, and thus sufficient tenacity was not obtained.

Example 3

A yarn made of glass fiber is coated with a coating material to obtain a coated yarn, in which the coating material contains 2 to 36 parts by weight of a reinforcing agent composed of a mineral material per 100 parts by weight of a coating liquid containing polyurethane. Table 3 below shows results of the cut level test for the coated yarn thus formed.

TABLE 3

| Amount of reinforcing agent(parts by weight) | Number of rotations of blade (times) | Cut level |
|---|---|---|
| 2 | 9.9 | 3 |
| 3 | 20.1 | 5 |
| 20 | 31.7 | 5 |
| 35 | 42.5 | 5 |
| 36 | Not measurable | Not measurable |

It was found that when the amount of the reinforcing agent composed of the mineral material was 3 to 35 parts by weight per 100 parts by weight of the coating liquid, the cut level of '5' was given, and thus a high tenacity yarn having sufficient tenacity was obtained. However, it was found that when the amount of the reinforcing agent was 2 parts by weight, the cut level of '3' was given, and thus sufficient tenacity was not obtained. It was also found that when the amount of the reinforcing agent was 36 parts by weight, the cut level was not measurable because the coated yarn was broken during a manufacturing process.

Although the exemplary embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. A high tenacity yarn manufactured by a method, the method comprising:

firstly coating a yarn made of at least one of nylon and polyester wherein the yarn is fed from a bobbin to a first water bath containing a first coating material, and the yarn is coated with the first coating material while passing over a first roller provided in the first water bath at a speed of about 5 to 30 m per minute, and controlling a thickness of the first coating material coated on the yarn by controlling a degree of contact between a thickness control plate and the yarn by using the thickness control plate provided behind first the roller and being movable relative to the yarn, thus obtaining a firstly coated yarn, wherein the first coating material contains 3 to 35 parts by weight of a reinforcing agent composed of a mineral material per 100 parts by weight of a coating liquid containing polyurethane, and the mineral material is at least one of basalt, glass fiber, and iron in a powder form having a particle size of 30 to 500 μm;

firstly drying the firstly coated yarn passing through an inside of a first drying furnace, the firstly coated yarn being dried by far-infrared radiation at 100 to 600° C.;

secondly coating the dried firstly coated yarn with a second coating material which is obtained by diluting the first coating material to have a concentration of 60 to 80%, thus obtaining a secondly coated yarn, wherein the firstly coated yarn is fed from the first drying furnace to a second water bath containing the second coating material, and the firstly coated yarn is coated with the second coating material while passing over a second roller provided in the second water bath; and secondly drying the secondly coated yarn passing through an inside of a second drying furnace, the secondly coated yarn being dried by far-infrared radiation at 100 to 600° C. and a length of the second drying furnace being shorter than that of the first drying furnace, wherein the coating liquid further comprises carbon nanotubes, and, wherein the firstly coated yarn is dried by passing the first coated yarn through the inside of the first drying furnace at a first temperature to activate the carbon nanotubes coated on the yarn, and further wherein the first coated and dried yarn is further dried at a second temperature lower than the first temperature for drying the first coating.

* * * * *